US009554665B2

(12) United States Patent
Olivo et al.

(10) Patent No.: US 9,554,665 B2
(45) Date of Patent: Jan. 31, 2017

(54) DRAPERY HOLDBACK ASSEMBLY

(71) Applicants: Anthony Joseph Olivo, Darragh, PA (US); Barbara Kay Olivo, Darragh, PA (US)

(72) Inventors: Anthony Joseph Olivo, Darragh, PA (US); Barbara Kay Olivo, Darragh, PA (US)

( * ) Notice: Subject to any disclaimer, the term of this patent is extended or adjusted under 35 U.S.C. 154(b) by 0 days.

(21) Appl. No.: 14/753,525

(22) Filed: Jun. 29, 2015

(65) Prior Publication Data

US 2016/0374498 A1 Dec. 29, 2016

(51) Int. Cl.
*A47H 19/00* (2006.01)

(52) U.S. Cl.
CPC ..... *A47H 19/00* (2013.01)

(58) Field of Classification Search
CPC ..... A47H 19/00
See application file for complete search history.

(56) References Cited

U.S. PATENT DOCUMENTS 1,700,752 A * 2/1929 Vodicka ..... A47H 19/00 24/615
2,224,772 A * 12/1940 Ross ..... A47H 19/00 16/441
4,903,370 A * 2/1990 Erdmann ..... A47H 19/00 16/87.2
4,912,829 A * 4/1990 Hickey ..... A47H 19/00 160/349.2
5,517,722 A * 5/1996 Bender ..... A47H 19/00 16/87.2

FOREIGN PATENT DOCUMENTS

DE 9416880 * 10/1994

* cited by examiner

*Primary Examiner* — Blair M Johnson
(74) *Attorney, Agent, or Firm* — Dunlap Bennett & Ludwig PLLC

(57) ABSTRACT

A drapery holdback assembly having interchangeable, adjustable decorative ends is provided. The drapery holdback includes a base portion for mounting to a supporting surface. A neck portion extends from the base portion to a distal head portion, which provides an arcuate magnet along a portion of its periphery. The drapery holdback includes an interface assembly having a decorative end and an opposing joint end, wherein the joint end forms a magnetically attractive curved surface so as to be movable and/or positionable over the arcuate magnet to various orientations. Being magnetically connected, different interface assemblies and so different decorative ends, may be interchanged onto the head portion at the user's whim. A spring is disposed between the decorative and joint ends, so that the interface assembly absorbs shock and other compressive forces to prevent damage to the drapery holdback assembly.

8 Claims, 4 Drawing Sheets

DRAPERY HOLDBACK ASSEMBLY

BACKGROUND OF THE INVENTION

The present invention relates to interior design and, more particularly, to a drapery holdback assembly having interchangeable decorative ends.

Current drapery holdbacks are either made of one piece with a decorative end, providing no options for changing the decorative end. Moreover, the current decorative ends are stationary, providing no options for adjusting the orientation of the sole decorative end. Thus, at best, current drapery holdbacks are limited to one, stationary decorative end without the ability to interchange.

As can be seen, there is a need for a drapery holdback assembly having adjustable and interchangeable decorative ends, affording decorative changes.

SUMMARY OF THE INVENTION

In one aspect of the present invention, a drapery holdback assembly having interchangeable, adjustable decorative ends includes a post extending from a base portion to a head portion; a mounting bolt slot disposed on the base portion; a magnetic disposed along a portion of a periphery of the head portion; and an interface assembly extending from a decorative end to a joint end, wherein the joint end forms a magnetically attractive curved surface.

In another aspect of the present invention, a drapery holdback assembly having interchangeable, adjustable decorative ends includes: a post extending from a base portion to a neck portion and further to a head portion; a mounting bolt slot disposed on the neck portion; a hollow cavity formed by the base portion so as to communicate to the mounting bolt slot; a mounting base dimensioned to be received within the hollow cavity; a mounting bolt perpendicularly joined to the mounting base, wherein the mounting bolt is dimensioned and adapted secure to the mounting bolt slot; an arcuate magnet disposed along a portion of a periphery of the head portion; an interface assembly extending from an interchangeable decorative end to a joint end, wherein the interface assembly includes: a tubular button retainer extending from a first opening to a second opening, wherein a retainer threading is formed along an interior portion of the first opening; a bowl-shaped contact button that extends from the joint end to a retainer lip, wherein the contact button protrudes through the second opening at least up to the retainer lip, forming the cavity, and wherein the joint end forms a magnetically attractive curved surface; and an interface disc that interconnects the button retainer and the interchangeable decorative end, wherein a disc threading is formed along a periphery of the interface disc so as to be mateable with the retainer threading, wherein the interface assembly forms a cavity extending from the decorative end to the joint end; and a spring housed within the cavity.

These and other features, aspects and advantages of the present invention will become better understood with reference to the following drawings, description and claims.

DETAILED DESCRIPTION OF THE INVENTION

Figure 1:
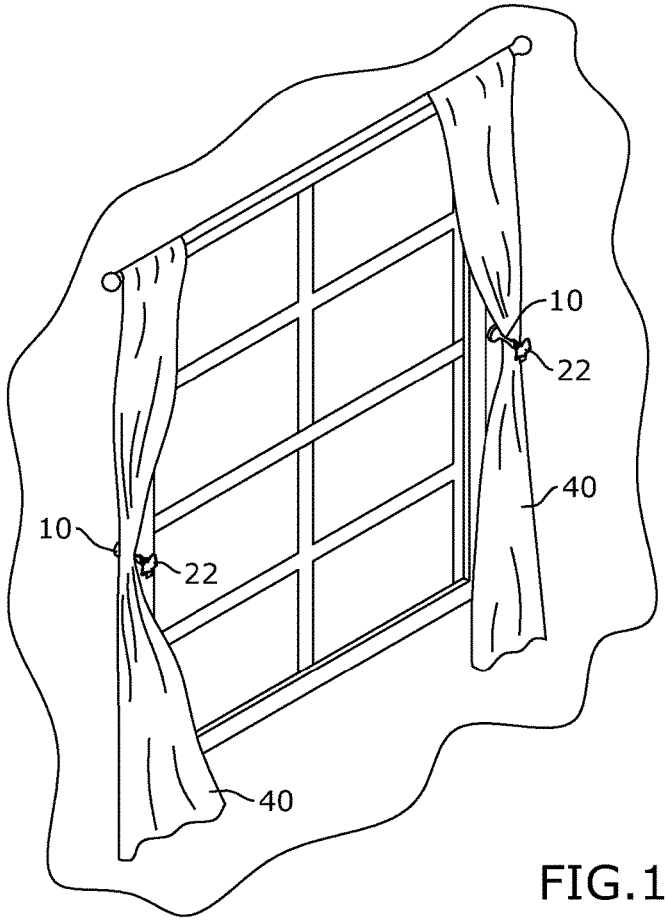
FIG. 1 is a perspective view of an exemplary embodiment of the present invention, shown in use.
Figure 2:
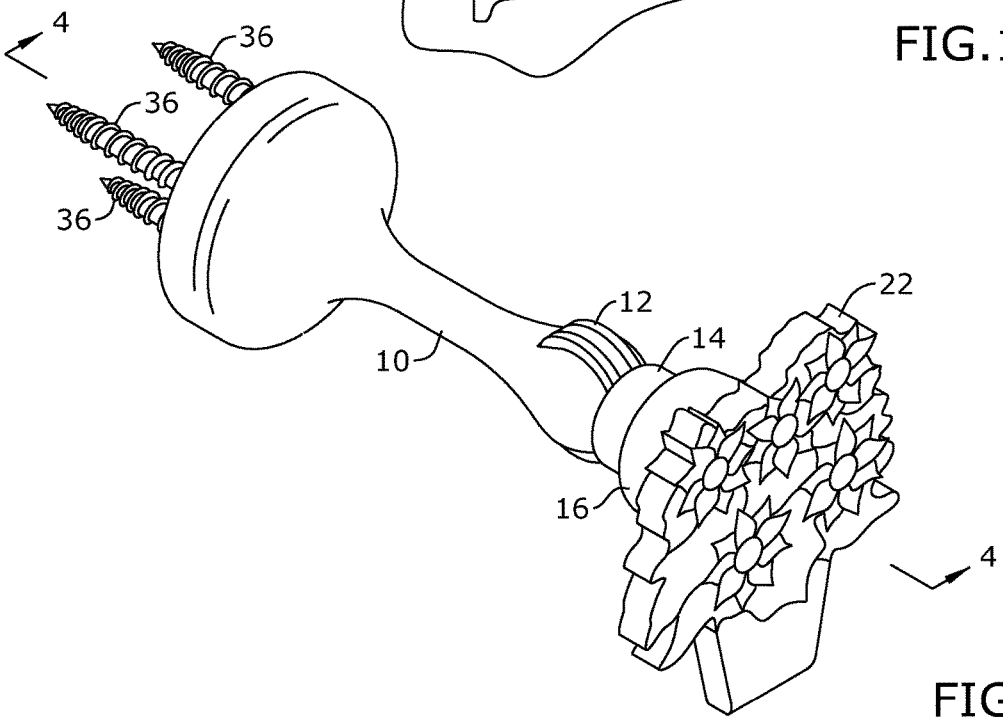
FIG. 2 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a drapery holdback assembly having interchangeable, adjustable decorative ends. The drapery holdback includes a base portion for mounting to a supporting surface. A neck portion extends from the base portion to a distal head portion, which provides an arcuate magnet along a portion of its periphery. The drapery holdback includes an interface assembly having a decorative end and an opposing joint end, wherein the joint end forms a magnetically attractive curved surface so as to be movable and/or positionable over the arcuate magnet to various orientations. Being magnetically connected, different interface assemblies and so different decorative ends, may be interchanged onto the head portion at the user's whim. A spring is disposed between the decorative and joint ends, so that the interface assembly absorbs shock and other compressive forces to prevent damage to the drapery holdback assembly.

Referring to FIGS. 1 through 6, the present invention may include a drapery holdback 10. The drapery holdback 10 may include a post having base portion 52, a neck portion and a head portion 56. The base portion 52 may form a circular shape having a base opening for mounting to a supporting surface 38. The neck portion 54 may generally perpendicularly extend from near the center of the base portion 52 to the bulbous head portion 56, as illustrated in the FIGS. The drapery holdback 10 may be a unitary construction made of any suitable durable material, including but not limited to metal, various plasticized materials, rubber, and the like. In certain embodiments, the drapery holdback 10 may be separate components joined together.

Figure 3:
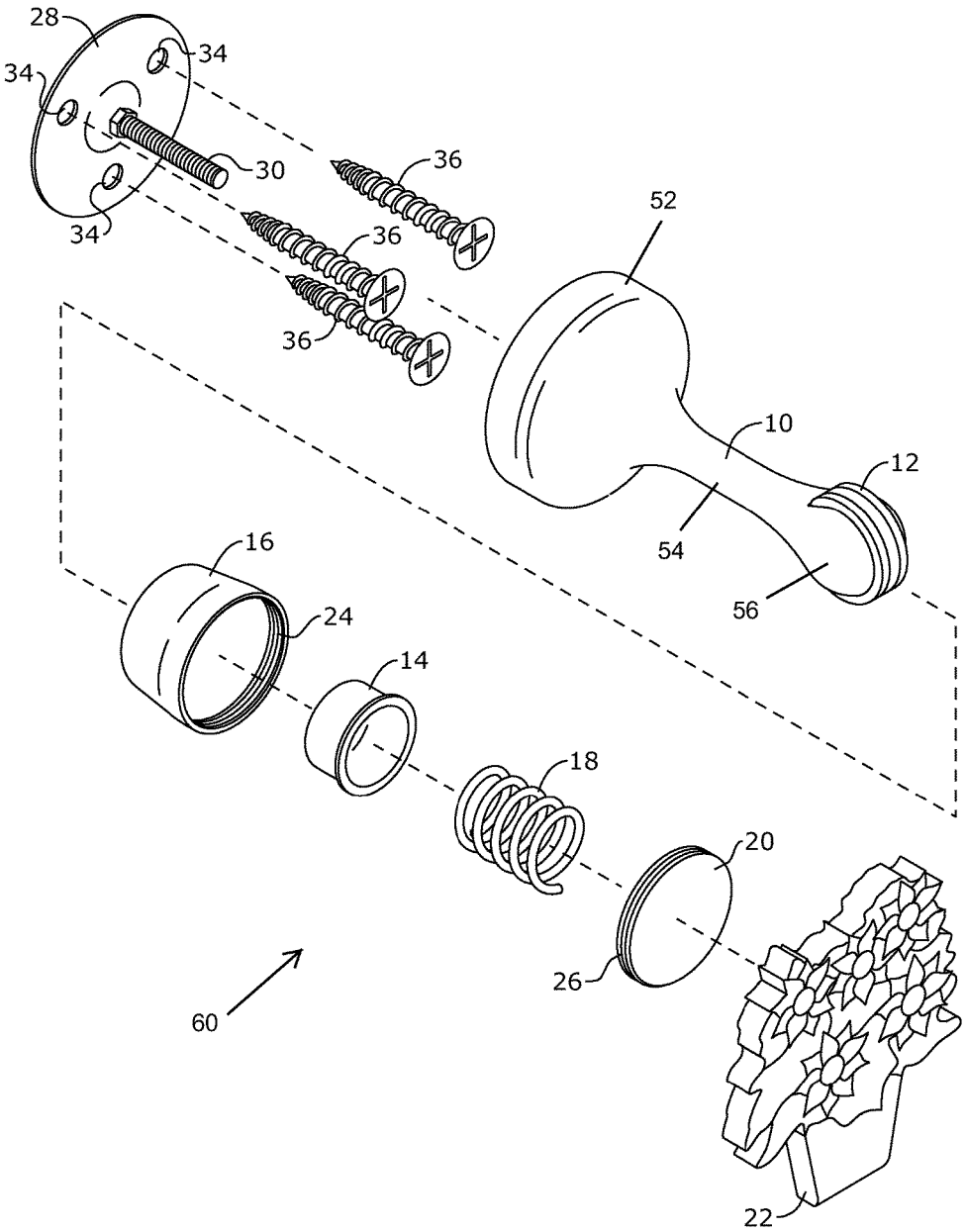
FIG. 3 is an exploded view of an exemplary embodiment of the present invention.
Figure 4:
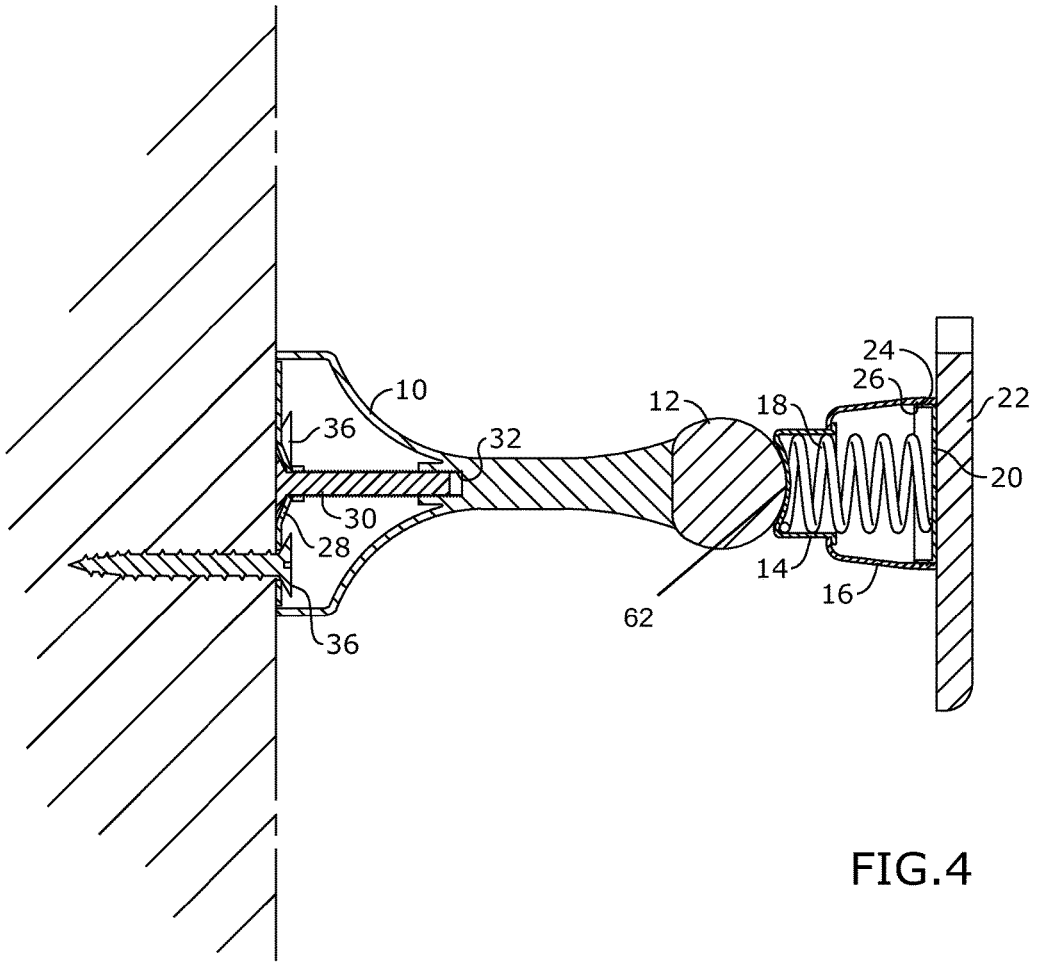
FIG. 4 is a section view of an exemplary embodiment of the present invention, taken along line 4-4 of FIG. 2.

The base portion 52 may be substantially hollow so that the base opening communicates to a proximal end of the neck portion, as illustrated in FIG. 4. Said proximal end may form a bolt slot 32, which may be considered within the hollow base portion 52. A mounting base 28 may be dimensioned and adapted to be received within the base opening, as illustrated in FIG. 4. The mounting base 28 may form a plurality of peripheral apertures 34, as illustrated in FIG. 3. A mounting bolt 30 may be perpendicularly joined to the center of the mounting base 28, and the mounting bolt 30 may be dimensioned and adapted to secure to the bolt slot 32. The peripheral apertures are dimensioned and adapted to support a plurality of fasteners 36 to connect the mounting base 28 to the supporting surface 38.

A magnet 12 may be disposed along a portion of a circumference of the bulbous head portion 56, as illustrated in FIG. 3. The magnet 12 thus may be arcuate shaped.

Figure 5:
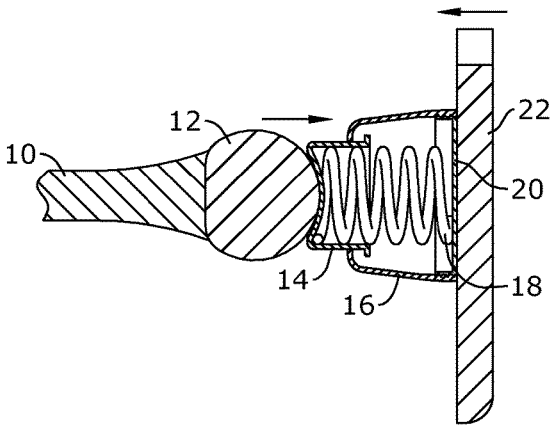
FIG. 5 is a detail section view of an exemplary embodiment of the present invention, demonstrating an operative effect.
Figure 6:
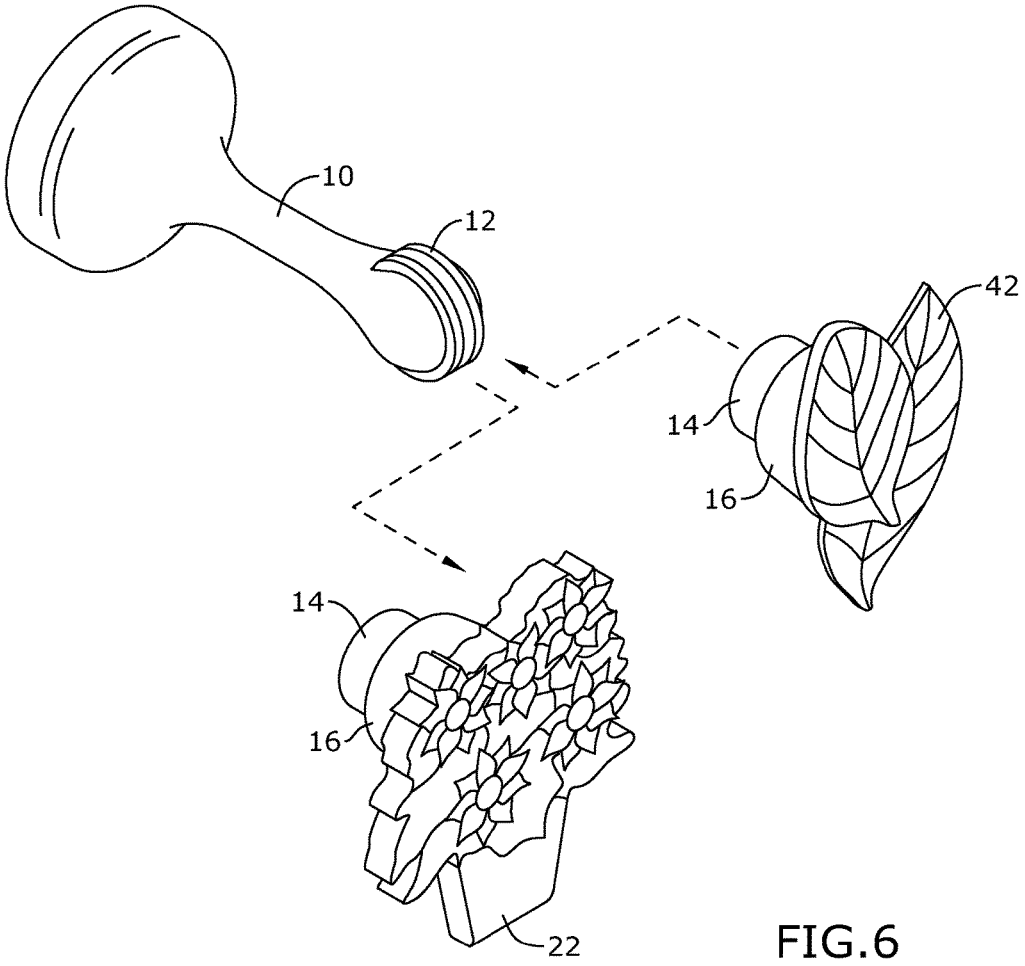
FIG. 6 is an exploded view of an exemplary embodiment of the present invention, demonstrating interchangeable functionality.

An interface assembly 60 may be provided. The interface assembly 60 may include a contact button 14, a button retainer 16, a spring 18 and an interface disc 20. The button retainer 16 may be a hollow tube extending from a first opening to a second opening. The first opening may be dimensioned and adapted to receive the contact button 14, while second opening is dimensioned and adapted to receive all but a retained lip of the contact button 14 so that the remaining portion of the contact button 14 protrudes from the second opening, as illustrated in FIGS. 4 and 5. Such a configuration allows the contact button 14 and the button retainer 16 to move relative to each other along their generally shared longitudinal axis. Retainer threading 24 may be formed along an interior portion of the button retainer 16, inward from the first opening, as illustrated in FIG. 3.

The contact button 14 may extend from its retained lip to a joint end 62, forming a cavity therein, thereby being bowl-shaped. The joint end 62 is made of ferromagnetic material or other suitable material to be sufficiently magnetically attracted to the magnet 12. The joint end 62 may form a curved surface dimensioned and adapted to ride over, to be movable over, or otherwise be positioned along the arcuate magnet 12.

The interface disc 20 may provide disc threading 26 along its periphery. The interface disc 20 may be dimensioned and adapted so the disc threading 26 may mate with the retainer threading along the interior portion of the button retainer 16, thereby enclosing the first opening.

The spring 18 may be housed in the cavity of the contact button 14 and the lumen of the tubular button retainer 16, so that the spring 18 generally extends from the joint end 62 to interface disc 20, thereby providing shock-absorbing, spring biasing to the interface assembly 60. By the same token, the spring 18 keeps the contact button 14 protruding through the second opening of the button retainer 16.

The interface disc 20 may be joined to a decorative end 22, or an alternative decorative end 42, or any decorative end providing sufficient surface area to join to the interface disc 20. In alternative embodiments, each decorative end 22, 42, etc., will provide something analogous to the interface disc with disc threading or the like for mating with the retainer threading 24, the first opening, and/or the button retainer directly.

A method of using the present invention may include the following. The drapery holdback 10 disclosed above may be provided. A user may use the fasteners 36 to connect the mounting base 28 to the supporting surface 38 so that the mounting bolt 30 extends generally perpendicularly there from. Then the user secures the mounting bolt 30 to the bolt slot 32, typically by screwing. Then the user my magnetically engage the magnet 12 and the joint end 62 so that the decorative end 22 of the interfacing assembly 60 is oriented as desired, whereby the interface assembly 60 is movable about the arcuate magnet as the joint end 62 rides thereon, affording dynamic decorative variations. The spring loaded functionality of the interface assembly 60 provides protection against the decorative end being damaged when bumped or whatnot, as the spring 18 provides give to absorb compressive forces, as illustrated in FIG. 5. Then the user may use the drapery holdback to hold back drapes/curtains 40, as illustrated in FIG. 1. When desired, the user may interchange decorative end 22 with decorative end 42 so as to afford decorative changes.

In certain embodiments, the drapery holdback 10 can be used in conjunction with rope or fabric tiebacks, whereby the loop of such tiebacks can be placed over the head and neck portions 54, 56 prior to the interface assembly 60 being attached.

In certain embodiments, the drapery holdback 10 can be used as a towel holder, for example by draping a towel over the head and neck portions 54, 56 with or without the interface assembly 60 attached.

It should be understood, of course, that the foregoing relates to exemplary embodiments of the invention and that modifications may be made without departing from the spirit and scope of the invention as set forth in the following claims.

What is claimed is:

1. A drapery holdback assembly having interchangeable, adjustable decorative ends, comprising:
- a post extending from a base portion to a head portion;
- a mounting bolt slot disposed within the base portion;
- a magnet disposed along a portion of a periphery of the head portion; and
- an interface assembly extending from a decorative end to a joint end, wherein the joint end forms a magnetically attractive curved surface, and wherein the interface assembly forms a cavity extending from the decorative end to the joint end for housing a spring;
- the interface assembly comprises:
- a tubular button retainer extending from a first opening to a second opening; and
- a bowl-shaped contact button that extends from the joint end to a retainer lip, wherein the contact button protrudes through the second opening at least up to the retainer lip, forming the cavity.

2. The drapery holdback assembly of claim 1, further comprising the spring housed within the cavity.

3. The drapery holdback assembly of claim 2, further comprising an interface disc that interconnects the button retainer and the decorative end.

4. The drapery holdback assembly of claim 3, further comprising:
- a retainer threading formed along an interior portion of the first opening of the button retainer; and
- a disc threading formed along a periphery of the interface disc, wherein the retainer and disc threadings are mateable.

5. The drapery holdback assembly of claim 1, further comprising a neck portion of the post that interconnects the base portion and the head portion, wherein the mounting bolt slot is disposed, and wherein the base portion forms a hollow cavity communicating to the mounting bolt slot.

6. The drapery holdback assembly of claim 5, further comprising:
- a mounting base dimensioned to be received within the hollow cavity; and
- a mounting bolt perpendicularly joined to the mounting base, wherein the mounting bolt is dimensioned and adapted secure to the mounting bolt slot.

7. The drapery holdback assembly of claim 1, wherein the magnet is arcuate shaped.

8. A drapery holdback assembly having interchangeable, adjustable decorative ends, comprising:
- a post extending from a base portion to a neck portion and further to a head portion;
- a mounting bolt slot disposed on the neck portion;
- a hollow cavity formed by the base portion so as to communicate to the mounting bolt slot;
- a mounting base dimensioned to be received within the hollow cavity;

a mounting bolt perpendicularly joined to the mounting base, wherein the mounting bolt is dimensioned and adapted secure to the mounting bolt slot;

an arcuate magnet disposed along a portion of a periphery of the head portion;

an interface assembly extending from an interchangeable decorative end to a joint end, wherein the interface assembly comprises:

a tubular button retainer extending from a first opening to a second opening, wherein a retainer threading is formed along an interior portion of the first opening;

a bowl-shaped contact button that extends from the joint end to a retainer lip, wherein the contact button protrudes through the second opening at least up to the retainer lip, forming the cavity, and wherein the joint end forms a magnetically attractive curved surface; and an interface disc that interconnects the button retainer and the interchangeable decorative end, wherein a disc threading is formed along a periphery of the interface disc so as to be mateable with the retainer threading, wherein the interface assembly forms a cavity extending from the decorative end to the joint end; and a spring housed within the cavity.

* * * * *